United States Patent [19]

Mosburger

[11] 3,968,713

[45] July 13, 1976

[54] MACHINE FOR CROSS-CUTTING A WEB OF MATERIAL

[75] Inventor: Hans Mosburger, Weiherhammer, Oberpfalz, Germany

[73] Assignee: BHS-Bayerische Berg Hutten-und Salzwerke Aktiengesellschaft, Munich, Germany

[22] Filed: Sept. 2, 1975

[21] Appl. No.: 609,364

[30] Foreign Application Priority Data

Sept. 19, 1974 Germany ..... 2444704

[52] U.S. Cl. ..... 83/347; 83/343; 83/859

[51] Int. Cl.[2] ..... B26D 1/36

[58] Field of Search ..... 83/331, 343–348, 83/859

[56] References Cited

UNITED STATES PATENTS

| | | | |
|---|---|---|---|
| 2,704,049 | 3/1955 | Vogt | 83/346 X |
| 3,808,925 | 5/1974 | Hards | 83/346 |
| 3,826,165 | 7/1974 | Currie | 83/346 X |

*Primary Examiner*—J. M. Meister
*Attorney, Agent, or Firm*—Silverman & Cass, Ltd.

[57] ABSTRACT

A machine for cross-cutting a web of material. A roller-mounted knife carrier is supported along its length on a bend-resistant support by supporting plates which are rotatably driven in synchronization with the knife carrier. The plates are of generally circular configuration with recesses on the circumference thereof to permit passage of the knife therethrough.

9 Claims, 2 Drawing Figures

MACHINE FOR CROSS-CUTTING A WEB OF MATERIAL

BACKGROUND OF THE INVENTION

This invention relates generally to a machine for cross-cutting a web of material such as a running sheet of corrugated cardboard, and more specifically, to such a machine having a knife retained in a knife carrier that is arranged crosswise with respect to the sheet of material to be cut. The knife carrier is supported over its entire length on a stationary, bend-resistant support by supporting plates which are rotatably driven in synchronization with the knife carrier.

SUMMARY OF THE INVENTION

Machines for cross-cutting a running web of corrugated cardboard are known. Such machines include a cylindrical knife carrier which is supported by supporting plates in the form of eccentric disks that are rotatably driven in synchronization with the cutting roller. An example of such a machine is disclosed in German Patent No. 1 808 981. In prior machines such as that disclosed in the referred-to German patent, the cutting roller is supported only on a short side thereof in the cutting position when the eccentric supporting disks are in supported contact with the cutting roller. In operation of such machine, immediately prior to and after engagement of the roller in its cutting postion, the eccentric supporting disks are moved out of contact with the cutting roller and the cutting roller then is in an unsupported condition. Thus, while cutting loads in prior art machines can be absorbed directly in the cutting position of the roller, possible undesirable vibrations of the cutting roller are not avoided in such machines. Furthermore, the weight of the cutting roller of such machines is not supported over the entire area of rotation of the roller.

The invention herein provides an improved machine in which the cutting roller thereof is supported over the entire length thereof. Further, the cutting roller herein moves with changes in the speed of the machine without undue delay. The invention accomplishes these objects by the provision of a knife carrier having an insignificant mass moment of inertia, and the provision of supporting plates having generally circular configuration with recesses on the circumference thereof to permit passage of the knife therethrough.

In the invention herein, known gearings for the generation of non-uniform rotative movement, as well as motors and brake coupling combinations which can produce periodic fluctuations in the number of rotations, are suitable as drive means for the cutting roller. These elements may be of much smaller size than that usually required because the mass moment of inertia of the knife carrier herein is substantially less than that of prior machines; the knife carrier therefore is quickly and easily adjustable with small-size control elements.

Other advantages of the invention will be apparent to those skilled in the art from the ensuing disclosure.

DESCRIPTION OF THE PREFERRED EMBODIMENT

Figure 1:
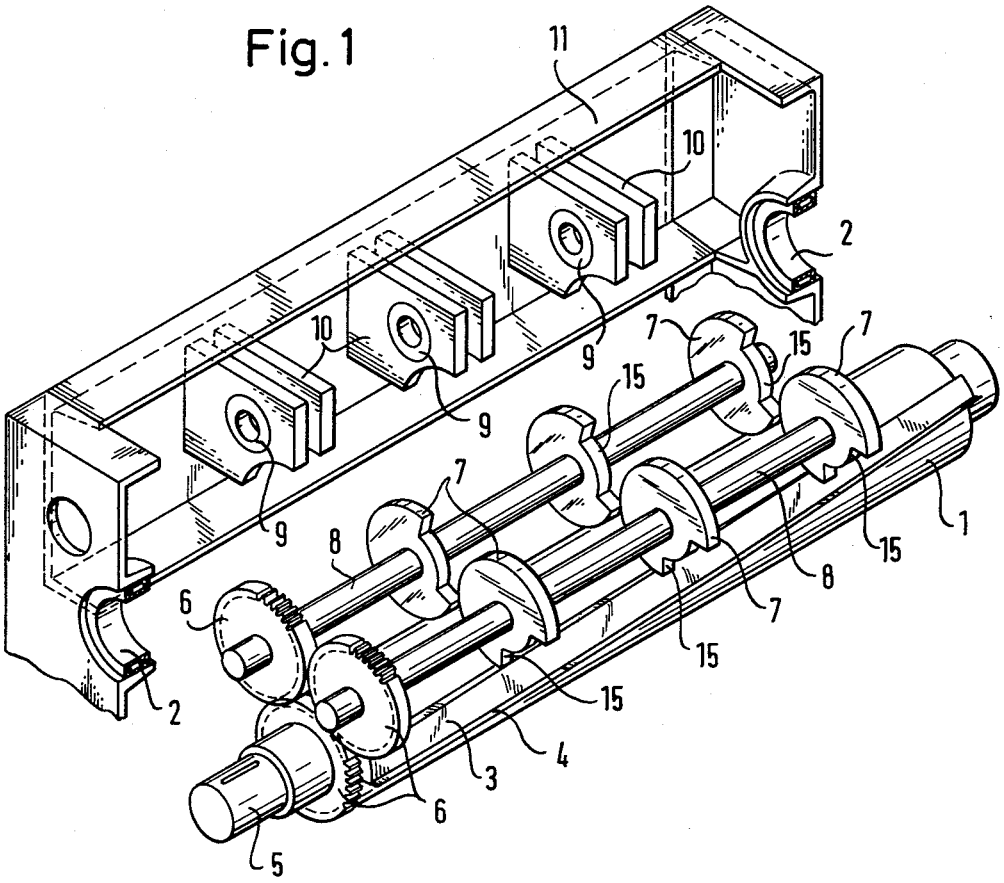
FIG. 1 is a perspective schematic view of the cross-cutting device of the invention, the same being shown partially exploded for better understanding thereof.
Figure 2:
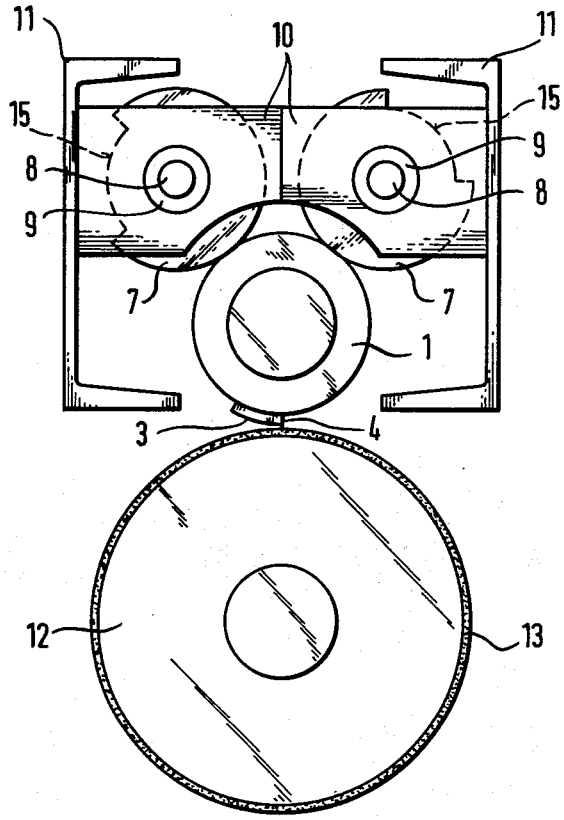
FIG. 2 is a lateral sectional view taken through said device and a roller associated therewith.

The cross-cutting device includes a cutting roller 1 which has a relatively small diameter and is mounted in roller bearings 2 on both ends. The roller 1 carries a knife holder 3 with the knife blade 4. In order to obtain minimal cutting forces and the most uniform support for the roller, the knife holder 3 preferably has a slight pitch as shown. Drive for the cutting roller 1 is effected at one end 5 thereof to enable a periodically variable number of revolutions. The drive arrangement required for this purpose is of known type and is therefore not illustrated.

Supporting plates or rollers 7 are driven with the same number of revolutions as the cutting roller 1 by gears 6 mounted on shafts 8. The shafts 8 are disposed parallel to cutting roller 1. The supporting rollers 7 are arranged stationary on their respective shafts at a distance from one another and somewhat staggered relative to each other. The supporting rollers 7, which are arranged in pairs, support the cutting roller 1. Each roller 7 has a recess 15 on the circumference thereof to permit the passage of the knife blade 4 and the holder 3 therethrough. In cutting operation of the device, a web of material to be cut is passed between the rollers 7 and roller 1. The cutting forces which tend to bend the cutting roller 1 are absorbed by the supporting rollers 7 and transferred to the traverses 10 by way of bearings 9 and thereby into the main carrier 11 to prevent undesirable bending of the cutting roller. The shafts 8 are rotatably supported in bearings 9.

The device of the invention is adapted for operation with two such knife blades 4 which are operable against each other to produce a scissors cut. In the drawings, however, an embodiment to effect a punch cut is illustrated. In this case, the knife 4 cuts against a roller 12 which rotates at the same speed as the web (not shown). The roller 12 is covered with any material 13 suitable for protecting the roller during punch cut operation.

If it is desired to have the cutting roller 1 function as a tool, the supporting gears 6 can assume support of the device and bracing of the cutting roller. In this case it is possible to reduce the weight of the cutting roller even more with the result that the same has a still reduced mass moment of inertia.

The invention is of special advantage if the cutting roller 1 carries a knife 4 which is disposed generally slanted to the surface lines of the knife carrier 3 in the longitudinal direction thereof. In such case, the supporting rollers 3 with their recesses for the passage of the knife 4 are arranged staggered relative to one another. With such structure an even more uniform support of the knife carrier over the entire length of the carrier is achieved. A practical embodiment of the invention could be designed and dimensioned as next set forth:

1. Cylindrical knife carrier 1, of steel St 50; diameter: 130 mm length: 2800 mm.

2. Main carrier 11, welded structure of steel St 37; thickness: 10 mm length: 2550 mm.

3. Traverses 10 of the carrier 11, of steel St 37; thickness: 30 mm length: 350 mm width: 210 mm.

4. Supporting rollers 7, of steel St 50; diameter: 147 mm thickness: 20 mm.

The recess 15 extends over an angle of 95°.

5. Shafts 8, of steel St 50; diameter: 25 mm.

The mass moment of inertia thus obtained for the knife carrier is ca. 1 $kgm^2$, whereas the mass moment of inertia of known knife carriers amounts to approximately . . . 10 $kgm^2$.

I claim:

1. Machine for cross-cutting a web of material comprising, a knife blade carried in a rotatable knife carrier arranged transverse to the web of material, a plurality of supporting plates arranged in supporting engagement with said blade along the entire length thereof, said knife carrier and said plates being drivable rotatively in synchronization, said knife carrier having a low mass moment of inertia, said support plates being of generally circular configuration, and each plate having a recess formed on the circumference thereof to permit passage of the knife blade therethrough.

2. Machine as claimed in claim 1 in which said knife carrier is mounted on a cutting roller, said support plates being positioned on at least two shafts, said shafts being disposed generally parallel with each other and with the longitudinal axis of the cutting roller.

3. Machine as claimed in claim 2 in which said shafts are positioned opposite the cutting edge of the knife blade.

4. Machine as claimed in claim 3 in which corresponding one ends of the shafts and the roller are interconnected by respective gears.

5. Machine as claimed in claim 1 in which there are two knife carriers each carrying a respective knife blade, the knife blades being cooperatively arranged to sever the web in scissors-cut fashion, each blade being supported by respective supporting plates.

6. Machine as claimed in claim 1 including a web transport roller to move the web against the knife carrier, and the knife carrier engages the transport roller in punchout cut fashion.

7. Machine as claimed in claim 6 in which the web transport roller is provided with protective covering to prevent damage thereto from the knife blade.

8. Machine as claimed in claim 1 including a lower roller and said knife carrier is positioned on said lower roller.

9. Machine as claimed in claim 1 in which said knife carrier is mounted on a cutting roller, said knife carrier being disposed generally slanted to the surface of the cutting roller in the longitudinal direction thereof, and said supporting plates are arranged staggered relative to one another.

* * * * *